US009309480B2

(12) United States Patent
Loop et al.

(10) Patent No.: US 9,309,480 B2
(45) Date of Patent: Apr. 12, 2016

(54) LUBRICANT COMPOSITION COMPRISING ANTI-FOAM AGENTS

(75) Inventors: John G. Loop, Perry, OH (US); William D. Abraham, Concord, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 91 days.

(21) Appl. No.: 13/982,285

(22) PCT Filed: Jan. 26, 2012

(86) PCT No.: PCT/US2012/022639

§ 371 (c)(1), (2), (4) Date: Oct. 1, 2013

(87) PCT Pub. No.: WO2012/106170

PCT Pub. Date: Aug. 9, 2012

(65) Prior Publication Data

US 2014/0018267 A1 Jan. 16, 2014

Related U.S. Application Data

(60) Provisional application No. 61/437,704, filed on Jan. 31, 2011.

(51) Int. Cl.

| | |
|---|---|
| ***C07F 7/02*** | (2006.01) |
| ***C10M 169/04*** | (2006.01) |
| ***C10M 139/04*** | (2006.01) |
| ***C10M 155/02*** | (2006.01) |
| ***C10M 167/00*** | (2006.01) |

(52) U.S. Cl.

CPC ..... *C10M 139/04* (2013.01); *C10M 155/02* (2013.01); *C10M 167/00* (2013.01); *C10M 169/048* (2013.01); *C10M 2229/041* (2013.01); *C10M 2229/051* (2013.01); *C10N 2220/022* (2013.01); *C10N 2230/02* (2013.01); *C10N 2230/18* (2013.01); *C10N 2230/43* (2013.01); *C10N 2230/45* (2013.01); *C10N 2240/102* (2013.01)

(58) Field of Classification Search

CPC ..... C10M 139/04; C10M 155/02
USPC ..... 508/201, 206
See application file for complete search history.

(56) References Cited

U.S. PATENT DOCUMENTS

| | | | | |
|---|---|---|---|---|
| 5,766,513 | A * | 6/1998 | Pillon et al. | 516/123 |
| 6,251,840 | B1 * | 6/2001 | Ward et al. | 508/162 |
| 2006/0264339 | A1 * | 11/2006 | Devlin et al. | 508/188 |

OTHER PUBLICATIONS

Written Opinion of Corresponding International Application No. PCT/US2012/022639 Filed Jan. 26, 2012.
Corresponding International Publication No. WO 2012/106170 A1published Aug. 9, 2012.
Dow Corning Corporation Material Safety Data Sheet, Dow Corning(R) 200 Fluid, 100,000 CST, 1 (2011), http://www.dowcorning.com/applications/search/default.aspx?R=87EN.
Dow Corning Corporation Material Safety Data Sheet, Dow Corning(R) 200 Fluid, 100,000 CST, 4 (2011), http://www.dowcorning.com/applications/search/default.aspx?R=87EN.

* cited by examiner

*Primary Examiner* — Prem C Singh
*Assistant Examiner* — Francis C Campanell
(74) *Attorney, Agent, or Firm* — David M. Shold; Teresan W. Gilbert

(57) ABSTRACT

The disclosed invention relates to a multigrade lubricant composition which can be used for numerous lubricant applications, but is particularly useful for lubricating a diesel engine. The lubricant composition comprises an oil of lubricating viscosity, a detergent, a dispersant, a viscosity index improver, and a combination of anti-foam agents. The lubricant composition may be used for providing enhanced fuel economy and avoiding air entrainment problems when used in lubricating diesel engines.

17 Claims, No Drawings

LUBRICANT COMPOSITION COMPRISING ANTI-FOAM AGENTS

TECHNICAL FIELD

This invention relates to lubricant compositions. The lubricant compositions may be particularly suitable for lubricating diesel engines.

BACKGROUND

Historically, diesel engines, especially heavy duty diesel engines, have utilized 15W-40 multi-grade lubricants and higher viscosity grades. However, the demand for enhanced fuel economy is driving the marketplace to lower viscosity oils. This has led to increases in air entrainment with some engines resulting in "overflow" of the oil and shutdown of the engine. Air entrainment may arise from various mechanical sources, including mechanical flaws such as cracks or leaking parts or seals, or from the crankshaft splashing in oil in the oil pan, particularly if an excess of oil is present.

Antifoam agents are known, and in certain end-use applications (e.g., transmission fluids), mixtures of antifoam agents have been used. For instance, U.S. Pat. No. 6,251,840, Ward et al., Jun. 26, 2001, discloses a lubricating/functional fluid which exhibits in use improved antiwear and antifoaming properties. The improvements are said to result from use of 2,4-dimercapto-1,3,4-thiadiazole and derivatives thereof together with silicone and/or fluorosilicone antifoam agents.

SUMMARY

The problem, therefore, is to provide a multigrade lubricant composition with a relatively low viscosity that can be used to lubricate a diesel engine, optionally provide for enhanced fuel economy, and avoid foaming and/or air entrainment problems. This invention provides a solution to this problem.

The present invention thus provides a lubricant composition, comprising: an oil of lubricating viscosity; a detergent; a dispersant; a first anti-foam agent comprising a polydimethyl siloxane having a kinetic viscosity (absent solvent) at 25° C. in the range from about 10,000 to about 50,000 $mm^2/s$ (cSt); a second anti-foam agent comprising a polydimethyl siloxane having a kinetic viscosity (absent solvent) at 25° C. in the range from about 80,000 to about 120,000 $mm^2/s$ (cSt); and a third anti-foam agent comprising a fluorinated polysiloxane having a kinematic viscosity (absent solvent) at 25° C. in the range from about 50 to about 500 $mm^2/s$ (cSt).

In one embodiment, the invention relates to a multigrade lubricant composition, comprising: an oil of lubricating viscosity; a detergent; a dispersant; a viscosity index improver; a first anti-foam agent, the first anti-foam agent being derived from a first anti-foam composition comprising a polydimethyl siloxane dispersed or dissolved in an aromatic oil or a naphthenic hydrocarbon solvent, to provide a first anti-foam composition, the first anti-foam composition having a kinetic viscosity at 25° C. (absent solvent) in the range from about 10,000 to about 50,000 cSt; a second anti-foam agent, the second anti-foam agent being derived from a second anti-foam composition comprising a polydimethyl siloxane dispersed or dissolved in an aromatic oil or a naphthenic hydrocarbon solvent to provide a second anti-foam composition, the second anti-foam composition having a kinetic viscosity at 25° C. (absent solvent) in the range from about 80,000 to about 120,000 cSt; and a third anti-foam agent, the third anti-foam agent being derived from a third anti-foam composition comprising a fluorinated polysiloxane dispersed or dissolved in an aliphatic solvent or a solvent comprising a ketone (e.g., aliphatic ketone) having about 5 to about 16 carbon atoms, the third anti-foam composition having a kinematic viscosity at 25° C. (absent solvent) in the range from about 50 to about 500 cSt.

The present invention also provides a method of lubricating an engine, comprising: supplying to the engine the lubricant composition described herein.

DETAILED DESCRIPTION

All ranges and ratio limits disclosed in the specification and claims may be combined in any manner. It is to be understood that unless specifically stated otherwise, references to "a," "an," and/or "the" may include one or more than one, and that reference to an item in the singular may also include the item in the plural.

The terms "hydrocarbyl" and "hydrocarbon," when referring to groups attached to the remainder of a molecule, refer to groups having a purely hydrocarbon or predominantly hydrocarbon character within the context of this invention. Such groups include the following:

(1) Purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(2) Substituted hydrocarbon groups; that is, groups containing non-hydrocarbon substituents which do not alter the predominantly hydrocarbon character of the group. Examples include hydroxy, nitro, cyano, alkoxy, acyl, etc.

(3) Hetero groups; that is, groups which, while predominantly hydrocarbon in character, contain atoms other than carbon in a chain or ring otherwise composed of carbon atoms. Examples include nitrogen, oxygen and sulfur.

In general, no more than about three substituents or hetero atoms, and in one embodiment no more than one, will be present for each 10 carbon atoms in the hydrocarbyl or hydrocarbon group.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about 0.5 gram per liter at 25° C.

The term "TBN" refers to total base number. This is the amount of acid (perchloric or hydrochloric) needed to neutralize a material's basicity, expressed as milligrams of KOH per gram of sample.

The term "TAN" refers to total acid number. This is the amount of base (NaOH or KOH) needed to neutralize a material's acidity, expressed as milligrams of KOH per gram of sample.

The inventive lubricant composition may comprise one or more base oils which may be present in a major amount. The lubricant composition may have a viscosity of up to about 12.5 cSt at 100° C., or from about 3.8 to about 12.5 cSt at 100° C., or from about 4.1 to about 12.5 cSt at 100° C., or from about 5.6 to about 12.5 cSt at 100° C.

The lubricant composition may have an SAE Viscosity Grade of 0W-20, 0W-30, 5W-20, 5W-30, 10W-20, 10W-30, 15W-20 or 15W-30.

The oil of lubricating viscosity may be referred to as a base oil. The base oil may be selected from any of the base oils in the group definitions as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAO) | | | |
| Group V | All others not included in Groups I, II, III, or IV | | | |

The base oil may contain less than about 300 ppm sulfur and/or at least about 90% saturate content, determined by test procedure described in ASTM D2007. The base oil may have a viscosity index of at least about 120.

Groups I, II and III are mineral oil base stocks. The base oil may comprise natural or synthetic lubricating oils and mixtures thereof. Mixture of mineral oil and synthetic oils, particularly polyalphaolefin oils and ester oils, may be used. In certain embodiments, the oil of lubricating viscosity comprises a Group III oil. It is sometimes observed that lubricant based on Group III oils may have a greater tendency for foam formation than those prepared with Group I or II oils, and therefore, in such formulations, the present invention may be particularly efficacious.

Natural oils may include animal oils and vegetable oils (e.g. castor oil, lard oil, and other vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils may be included within the scope of useful oils.

Base oils derived from coal or shale may be useful. Synthetic lubricating oils may include hydrocarbon oils and halo-substituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, may constitute other classes of known synthetic lubricating oils that can be used. Another suitable class of synthetic lubricating oils that may be used comprises the esters of dicarboxylic acids and those made from about $C_5$ to about $C_{12}$ monocarboxylic acids and polyols or polyol ethers.

Other suitable synthetic lubricating oils may include liquid esters of phosphorus-containing acids, polymeric tetrahydrofurans, silicon-based oils such as the poly-alkyl-, polyaryl-, polyalkoxy-, or polyaryloxy-siloxane oils, silahydrocarbons and silicate oils.

Hydrotreated naphthenic oils may be used. Synthetic oils may be used, such as those produced by Fischer-Tropsch reactions and typically may be hydroisomerized Fischer-Tropsch hydrocarbons or waxes. The base oil may be prepared by a Fischer-Tropsch gas-to-liquid synthetic procedure as well as other gas-to-liquid procedures.

Unrefined, refined and rerefined oils, either natural or synthetic (as well as mixtures of two or more of any of these) of the type disclosed hereinabove may be used. Unrefined oils are those obtained directly from a natural or synthetic source without further purification treatment. Refined oils are similar to the unrefined oils except they have been further treated in one or more purification steps to improve one or more properties. Rerefined oils may be obtained by processes similar to those used to obtain refined oils applied to refined oils which have been already used in service. The rerefined oils often are additionally processed by techniques directed to removal of spent additives and oil breakdown products.

The amount of oil in a fully formulated lubricant will typically be the amount remaining to equal 100 percent after the remaining additives are accounted for. Typically this may be from about 60 to about 99 percent by weight, or from about 70 to about 97 percent, or from about 80 to about 95 percent, or from about 85 to about 93 percent by weight. The lubricant composition may be delivered as a concentrate, in which case the amount of oil is typically reduced and the concentrations of the other components are correspondingly increased. In such cases the amount of oil may be from about 30 to about 70 percent by weight, or from about 40 to about 60 percent by weight.

The detergent may comprise an overbased metal-containing material, which may be referred to as an overbased or superbased salt. The overbased material may comprise single phase, homogeneous Newtonian system characterized by a metal content in excess of that which would be present for neutralization according to the stoichiometry of the metal and the particular acidic organic compound reacted with the metal. The overbased materials may be prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material may have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio" is also explained in standard textbook entitled "Chemistry and Technology of Lubricants", Second Edition, Edited by R. M. Mortier and S. T. Orszulik, Copyright 1997.

The metal of the overbased metal-containing detergent may be zinc, sodium, calcium, barium, magnesium, or a mixture of two or more thereof. In one embodiment, the metal may be sodium, calcium, magnesium, or a mixture of two or more thereof.

The overbased metal-containing detergent may be selected from non-sulfur containing phenates, sulfur containing phenates, sulfonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g. phenate-salicylates, sulfonate-phenates, sulfonate-salicylates, sulfonates-phenates-salicylates, as described; for example, in U.S. Pat. Nos. 6,429,178; 6,429,179; 6,153,565; and 6,281,179. Where, for example, a hybrid sulfonate-phenate detergent is employed, the hybrid detergent would be considered equivalent to amounts of distinct phenate and sulfonate detergents introducing like amounts of phenate and sulfonate soaps, respectively.

The overbased metal-containing detergent may comprise zinc, sodium, calcium or magnesium salts of a phenate, sulfur containing phenate, sulfonate, salixarate or salicylate. Overbased salixarates, phenates and salicylates may have a total base number (ASTM D3896) in the range from about 180 to about 450 TBN. Overbased sulfonates may have a total base number in the range from about 250 to about 600, or in the range from about 300 to about 500. Overbased detergents are known in the art. The sulfonate detergent may be a predominantly linear alkylbenzene or alkyltoluene sulfonate detergent having a metal ratio of at least about 8 as is described in paragraphs [0026] to [0037] of U.S. Patent Publication 2005/065045. The linear alkyl group may be attached to the benzene or toluene at any location along the linear alkyl chain, such as the 2, 3, or 4 position. The linear alkylbenzene sulfonate detergent may be useful for improving fuel economy.

The overbased metal-containing detergent may be a calcium or magnesium overbased detergent. The lubricant composition may comprise an overbased calcium sulfonate, an overbased calcium phenate, or a mixture thereof. The overbased detergent may comprise a calcium sulfonate with a metal ratio of at least about 3.5, for example, in the range from about 3.5 to about 40, or in the range from about 5 to about 25, or in the range from about 7 to about 20.

The lubricant composition may further comprise a low overbased detergent (metal ratio of less than about 3.5, for example, in the range from about 0 to about 3.5, or in the range from about 0.5 to about 3.0, or in the range from about 1 to about 2.5, or in the range from about 1.5 to about 2) or a neutral detergent.

The detergent may be present in the lubricant composition at a concentration in the range from about 0.05% by weight to about 5% by weight of the lubricant composition. The detergent may be present at a concentration in the range from about 0.1%, about 0.3%, or about 0.5% up to about 3.2%, or about 1.7%, or about 0.9% by weight of the lubricant composition. Similarly, the detergent may be present in an amount suitable to provide a TBN (total base number) in the range from about 1 to about 10 to the lubricant composition. The detergent may be present in amount which provides a TBN in the range from about 1.5 up to about 3, or up to about 5, or up to about 7, to the lubricant composition. In some embodiments, the detergent may be present in an amount to deliver at least 1000 parts per million by weight of metal to the lubricant composition, such as 1000 to 10,000 ppm or 1500 to 9,000 ppm or 2000 to 8000 ppm. In some embodiments, the detergent may be present in an amount to provide the neutral salt component in an amount of 0.01 to 5 percent by weight, or 0.5 to 3, or 1 to 2 percent. The neutral salt component refers to that portion of the detergent corresponding to the neutralized acidic substrate with a metal ratio of 1, that is, excluding the excess basicity component (which may be present in part as $CaCO_3$ and other basic species such as hydroxides).

Metal-containing detergents, in addition to TBN, may also provide ash to the lubricant composition. Sulfated ash (ASTM D874) is another parameter often used to characterize overbased detergents and lubricant compositions. The lubricant composition may have sulfated ash levels of about 0.3 to about 1.2% by weight, or from about 0.3 to about 1.0% or from about 0.5 to about 1.0%, or greater than about 0.6%. In other embodiments (e.g., for marine diesel cylinder lubricants) the ash level may be from about 1 to about 15%, or from about 2 to about 12% by weight, or from about 4 to about 10%. The overbased detergent may account for about 50% to about 100% of the sulfated ash, or at least about 70% of the ash, or at least about 80% of the ash, or 100% of the ash. The overbased detergent may provide for no more than about 95% of the sulfated ash, or no more than about 98% of the sulfated ash.

The dispersant may be a succinimide dispersant, a Mannich dispersant, a succinamide dispersant, a polyolefin succinic acid ester, amide, or ester-amide, or mixtures thereof. The dispersant may be present as a single dispersant, or it may be present as a mixture of two or more (e.g., three) different dispersants, wherein at least one may be a succinimide dispersant.

The succinimide dispersant may be derived from one or more aliphatic polyamines. The aliphatic polyamine may be an aliphatic polyamine such as ethylenepolyamine (i.e., a poly(ethyleneamine)), a propylenepolyamine, a butylenepolyamine, or a mixture of two or more thereof. The aliphatic polyamine may be ethylenepolyamine. The aliphatic polyamine may be selected from ethylenediamine, diethylenetriamine, triethylenetetramine, tetraethylene-pentamine, pentaethylenehexamine, polyamine still bottoms, or a mixture of two or more thereof.

The succinimide dispersant may be derived from an aromatic amine, aromatic polyamine, or mixture thereof. The aromatic amine may have one or more aromatic moieties linked by a hydrocarbylene group and/or a heteroatom such as 4-amino diphenyl amine. The aromatic amine may be a nitro-substituted aromatic amine. Examples of nitro-substituted aromatic amines may include 2-nitroaniline, 3-nitroaniline, and 4-nitroaniline. 3-nitroaniline may be particularly useful. Other aromatic amines may be present along with the nitroaniline. Condensation products with nitroaniline and optionally also with Disperse Orange 3 (that is, 4-(4-nitrophenylazo)aniline) are disclosed in U.S. Patent Publication 2006/0025316.

The dispersant may comprise a polymer functionalized with an amine, e.g., a succinimide dispersant. The amine may be an amine having at least 2, or at least 3, or at least 4 aromatic groups, for instance, from about 4 to about 10, or from about 4 to about 8, or from about 4 to about 6 aromatic groups, and at least one primary or secondary amino group or, alternatively, at least one secondary amino group. The amine may comprise both a primary and at least one secondary amino group. The amine may comprise at least about 4 aromatic groups and at least 2 secondary or tertiary amino groups.

An example of an amine having 2 aromatic groups is N-phenyl-p-phenylenediamine. An example of an amine having at least 3 or 4 aromatic groups may be represented by Formula (1):

Formula 1

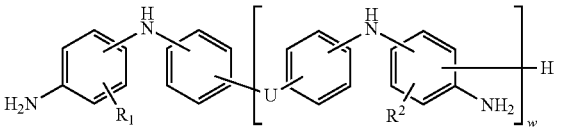

wherein, independently, each variable is as follows: $R^1$ may be hydrogen or a $C_{1-5}$ alkyl group (typically hydrogen); $R^2$ may be hydrogen or a $C_{1-5}$ alkyl group (typically hydrogen); U may be an aliphatic, alicyclic or aromatic group (when U is aliphatic, the aliphatic group may be a linear or branched alkylene group containing 1 to about 5, or 1 to about 2 carbon atoms); and w may be from 1 to about 10, or 1 to about 4, or 1 to 2 (typically 1). When U is an aliphatic group, U may be an alkylene group containing 1 to about 5 carbon atoms. Alternatively, the amine may also be represented by Formula (1a)

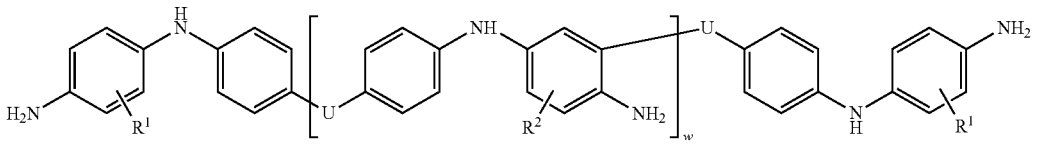

Formula (1a)

wherein each variable U, $R^1$, and $R^2$ are the same as described above and w is 0 to about 9, or 0 to about 3, or 0 to about 1 (typically 0).

The dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of from about 350 to about 5000, or from about 550 to about 3000 or from about 750 to about 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Pat. Appl. 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. The post-treated dispersant may be borated. The post-treated dispersant may result from a reaction of the dispersant with a dimercaptothiadiazole. The post-treated dispersant may result from a reaction of the dispersant with phosphoric or phosphorous acid.

The dispersant may be present in the lubricant composition at a concentration in the range from about 0.01 wt % to about 20 wt %, or from about 0.1 wt % to about 15 wt %, or from about 0.1 wt % to about 10 wt %, or from about 1 wt % to about 6 wt %, or from about 1 to about 3 wt % of the lubricating composition.

The lubricant composition may further include one or more viscosity index improvers, which may be referred to as viscosity modifiers. The presence of a viscosity index improver is typically characteristic of a multigrade lubricant composition. Viscosity modifiers may include hydrogenated styrene-butadiene rubbers, ethylene-propylene copolymers, polymethacrylates, polyacrylates, hydrogenated styrene-isoprene polymers, hydrogenated diene polymers, poly(alkyl styrenes), polyolefins, esters of maleic anhydride-olefin copolymers (such as those described in International Application WO 2010/014655), esters of maleic anhydride-styrene copolymers, or mixtures or two or more thereof. The viscosity index improver may be present in the lubricant composition at a concentration in the range of about 0 to about 20 wt %, or from about 2 to about 10 wt %.

The inventive lubricant composition may employ the combination of three anti-foam agents to reduce or eliminate the problem of foaming that results when operating certain heavy duty diesel engines and converting from a higher viscosity grade (e.g., 15W-40) lubricant composition to a lower viscosity grade (e.g., 10W-30) lubricant in order to provide for enhanced fuel economy. It may be particularly useful to prevent foaming in diesel engines having a power output of greater than about 750 kW (1000 horsepower (hp)), such as greater than about 1120 kW (1500 hp) or 1500 kW (2000 hp) or 2240 kW (3000 hp), and up to, for instance about 15,000 kW (20,000 hp) or to 7500 kW (10,000 hp).

The first anti-foam agent may be, or may be derived from, a first anti-foam composition which may comprise a polydimethyl siloxane. The siloxane may be dispersed or dissolved in an aromatic oil or a naphthenic solvent or oil, and typically in a naphthenic hydrocarbon solvent. A naphthenic hydrocarbon typically comprises a significant amount of saturated, cyclic hydrocarbon species (naphthenes), such as at least about 10 percent by weight thereof, or at least about 20 or 30 or 40 or 50 or 60 percent thereof, and up to about 90 or 80 or 70 percent. Certain amount of aromatic hydrocarbon content may also be present, such as about 2 to 50 or about 5 to 40 or about 10 to 30 percent. An example of a naphthenic hydrocarbon solvent is petroleum naphtha. The first anti-foam composition may be provided as a solution or dispersion comprising from about 1 to about 50 wt % of the polydimethylsiloxane, or from about 5 wt % to about 25 wt %, or about 10 wt % in the solvent, diluent, or oil. The first anti-foam composition, as provided, may comprise from about 50 wt % to about 99 wt % of the solvent, diluent, or oil, or from about 75 wt % to about 95 wt %, or about 90 wt % of the solvent, diluent, or oil. The first anti-foam composition may have a kinematic viscosity at 25° C. in the range from about 10,000 to about 50,000 $mm^2/s$ (cSt), or from about 20,000 to about 40,000 $mm^2s$ (cSt), or about 30,000 $mm^2/s$ (cSt) (these values referring to the polydimethylsiloxane in the absence of solvent or diluent). The concentration of the first anti-foam agent (i.e., the polydimethyl siloxane) in the lubricant composition may be in the range from about 50 to about 500 parts per million by weight (ppm), or from about 100 to about 300 ppm, or about 200 ppm. The foregoing amounts are based on the polydimethylsiloxane plus solvent/diluent as conventionally provided; corresponding amounts for the neat anti-foam agent may be, for instance, about 5 to about 50 ppm or about 10 to about 30 ppm or about 15 to about 25 ppm or about 20 ppm The second anti-foam agent may be, or may be derived from, a second anti-foam composition which may comprise a second polydimethyl siloxane. The second polydimethyl siloxane may be dispersed or dissolved in an aromatic oil or a naphthenic solvent or oil, and typically in a naphthenic hydrocarbon solvent. The second anti-foam composition may be provided as a solution or dispersion comprising from about 1 wt % to about 50 wt % of the polydimethylsiloxane, or from about 5 wt % to about 25 wt %, or about 12.5 wt % in the solvent, diluent, or oil. The second anti-foam composition, as provided, may comprise from about 50 wt % to about 99 wt % of the solvent, diluent, or oil, or from about 75 wt % to about 95 wt %, or about 87.5 wt % of the solvent, diluent, or oil. The second anti-foam additive composition may have a kinematic viscosity at 25° C. in the range from about 80,000 to about 120,000 $mm^2/s$ (cSt), or from about 90,000 to about 110,000 $mm^2/s$ (cSt), or about 100,000 $mm^2/s$ (cSt), (these values referring to the polydimethylsiloxane in the absence of solvent or diluent). The concentration of the second anti-foam agent (i.e., the polydimethyl siloxane) in the lubricant composition may be in the range from about 5 to about 100 ppm, or from about 10 to about 30 ppm, or about 15 ppm. The foregoing amounts are based on the polydimethylsiloxane plus solvent/diluent; corresponding amounts for the neat anti-foam agent may be, for instance, about 0.6 to about 13 ppm, or about 1.2 to about 3.8 ppm, or about 1.5 to about 2.5 ppm, or about 1.9 ppm.

The third anti-foam agent may be, or may be derived from, a third anti-foam composition. The third antifoam agent may comprise a fluorinated polysiloxane which may be dispersed or dissolved in an aliphatic solvent, or in a ketone solvent, or mixtures thereof. The ketone solvent may comprise a ketone having about 5 to about 16 carbon atoms, such as 6 to 12 carbon atoms or 8 carbon atoms. The fluorinated polysiloxane may be a poly(3,3,3-trifluoropropyl methyl siloxane). The solvent may be methylbutyl ethyl ketone (5-methyl-3-heptanone). The third anti-foam composition may comprise from about 5 wt % to about 95 wt % of the fluorinated polysiloxane, or from about 65 wt % to about 85 wt %, or about 75 wt %. The third anti-foam composition may comprise from about 5 wt % to about 95 wt % of the solvent, or from about 15 wt % to about 40 wt %, or about 25 wt % of the oil. The third anti-foam composition may have a kinematic viscosity at 25° C. in the range from about 50 to about 500 $mm^2/s$ (cSt), or from about 100 to about 500 $mm^2/s$ (cSt), or from about 200 to about 400 $mm^2/s$ (cSt), or about 300 $mm^2/s$ (cSt) (these values referring to the fluorinated polysiloxane in the absence of solvent or diluent). The concentration of the third anti-foam agent (i.e., the fluorinated polysiloxane) in the lubricant composition may be in the range from about 5 to about 95 ppm, or from about 20 to about 60 ppm, or about 40 ppm. The foregoing amounts are based on the fluorinated polysiloxane plus solvent/diluent as conventionally provided; corresponding amounts for the neat anti-foam agent may be, for instance, about 3.7 to about 71 ppm or about 15 to about 45 ppm or about 25 to about 35 ppm, or about 30 ppm.

All three of the anti-foam agents will be present, although optionally additional anti-foam agents may be present. Each of the three anti-foam agents described above may be present in an amount of about 1% or more by weight of the total anti-foam package (oil/solvent free basis). In certain embodiments, the first and third listed anti-foam agents may each independently be present at about 10% or more or 15% or more of the total antifoam package and the second anti-foam agent may be present at about 1% or more, or 1.5% or more, or 2% or more. In certain embodiments, the total amount of silicon-containing anti-foam agents may be an amount to deliver about 5 to 20, or 10 to 18, or 12 to 15 ppm silicon to the lubricant.

The lubricant composition may comprise other performance additives. These may include one or more metal deactivators, friction modifiers, antiwear agents, corrosion inhibitors, dispersant viscosity modifiers, extreme pressure agents, antioxidants, demulsifiers, pour point depressants, seal swelling agents, mixtures of two or more thereof, and the like.

The antioxidants may include sulfurized olefins, diarylamines, hindered phenols, molybdenum compounds (such as molybdenum dithiocarbamates), hydroxyl thioethers, or mixtures thereof. The antioxidant may be present at a concentration in the range from about 0 wt % to about 15 wt %, or about 0.1 wt % to about 10 wt %, or about 0.5 wt % to about 5 wt %, or about 0.5 wt % to about 3 wt % of the lubricant composition.

The diarylamine may be phenyl alpha-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant may contain a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. The hindered phenol antioxidant may be an ester, such as the ester available under the tradename Irganox™ L-135 from Ciba. Such materials may be represented by the general formula

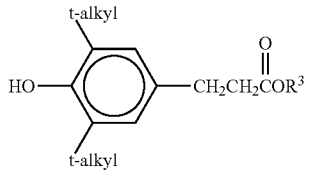

wherein $R^3$ is a hydrocarbyl group such as an alkyl group containing, e.g., 1 to about 18, or 2 to about 12, or 2 to about 8, or 2 to about 6 carbon atoms; and t-alkyl can be t-butyl. A detailed description of ester-containing hindered phenol antioxidants that may be used may be found in U.S. Pat. No. 6,559,105.

Examples of molybdenum dithiocarbamates which may be used as an antioxidant include commercial materials sold under trade names such as Vanlube 822™ and Molyvan™ A from R. T. Vanderbilt Co., Ltd., and Adeka Sakura-Lube™ S-100, S-165, S-525 and S-600 from Asahi Denka Kogyo K. K, and mixtures thereof.

The dispersant viscosity modifier may include functionalized polyolefins, for example, ethylene-propylene copolymers that have been functionalized with an acylating agent such as maleic anhydride and an amine; polymethacrylates functionalized with an amine, or esterified styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. The dispersant viscosity modifier may include those described in U.S. Pat. No. 4,863,623 (see column 2, line 15 to column 3, line 52) or in International Publication WO2006/015130 (see page 2, paragraph [0008] and preparative examples described in paragraphs [0065] to [0073]). The dispersant viscosity modifier may be present at a concentration of up to about 15 wt %, or up to about 10 wt %, or in the range from about 0.05 wt % to about 5 wt %, or from about 0.2 wt % to about 2 wt % of the lubricant composition.

The friction modifier may be selected from long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. As used herein the term "fatty alkyl or fatty" in relation to friction modifiers means a carbon chain having from about 10 to about 22 carbon atoms, typically a straight carbon chain. Alternatively, mono-branched alkyl groups may be used in place of the fatty alkyl groups. Typical mono-branched alkyl groups may include beta-branched groups such as 2-ethylhexyl, 2-propylheptyl, and the like. The friction modifier may be present in the lubricant composition at a concentration in the range from 0 wt % to about 6 wt %, or about 0.01 wt % to about 4 wt %, or from about 0.05 wt % to about 2 wt %, or from about 0.1 wt % to about 2 wt % of the lubricant composition.

Examples of friction modifiers that may be used may include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, and monoesters of a polyol and an aliphatic carboxylic acid derived or derivable from sunflower oil or soybean oil.

The friction modifier may be a long chain fatty acid ester. The long chain fatty acid ester may be a mono-ester, diester, triglyceride, or a mixture of two or more thereof.

The lubricant composition may optionally further include at least one antiwear agent. Examples of suitable antiwear agents may include tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides. The antiwear agent may, in one embodiment, include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least about 8.

Another class of additives may include oil-soluble titanium compounds as disclosed in U.S. Pat. No. 7,727,943 and U.S. Patent Publication 2006/0014651. These may function as antiwear agents, friction modifiers, antioxidants and/or deposit control additives. The oil soluble titanium compound may be a titanium (IV) alkoxide. The titanium alkoxide may be formed from a monohydric alcohol, a polyol or mixtures thereof. The monohydric alkoxides may contain from 2 to about 16 carbon atoms, or from 3 to about 10 carbon atoms. The titanium alkoxide may be titanium (IV) isopropoxide. The titanium alkoxide may be titanium (IV) 2-ethylhexoxide. The titanium compound may comprise the alkoxide of a vicinal 1,2-diol or polyol. The 1,2-vicinal diol may comprise a fatty acid mono-ester of glycerol, such as oleic acid.

The oil soluble titanium compound may be a titanium carboxylate. The titanium carboxylate may be derived from a titanium alkoxide and a carboxylic acid selected from the group consisting of a non-linear mono-carboxylic acid and a carboxylic acid having more than about 22 up to about 25 carbon atoms. Examples of titanium/carboxylic acid products may include titanium reaction products with acids selected from the group comprising caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like. Methods for making such titanium/carboxylic acid products are described, for example, in U.S. Pat. No. 5,260,466.

Extreme Pressure (EP) agents that are soluble in the oil may include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents may include chlorinated wax; sulfurized olefins (such as sulfurized isobutylene), a hydrocarbyl-substituted 2,5-dimercapto-1,3,4-thiadiazole, or oligomers thereof, organic sulphides and polysulphides such as dibenzyldisulphide, bis-(chlorobenzyl) disulphide, dibutyl tetrasulphide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Pour point depressants that may be used in the lubricant composition may include polyalphaolefins, esters of maleic anhydride-styrene copolymers, poly(meth)acrylates, polyacrylates or polyacrylamides.

Demulsifiers that may be used may include trialkyl phosphates, and various polymers and copolymers of ethylene glycol, ethylene oxide, propylene oxide, or mixtures of two or more thereof.

Metal deactivators may include derivatives of benzotriazoles (typically tolyltriazole), 1,2,4-triazoles, benzimidazoles, 2-alkyldithiobenzimidazoles or 2-alkyldithio-benzothiazoles. The metal deactivators may also be described as corrosion inhibitors.

Seal swell agents that may be used may include sulfolene derivatives such as Exxon Necton-37™ (FN 1380) and Exxon Mineral Seal Oil™ (FN 3200).

Although the lubricant composition is particularly suitable for lubricating diesel engines, especially heavy duty diesel engines, it may be used to lubricate any mechanical device, by supplying the lubricant as described herein to the device. The device may be an internal combustion engine such as a gasoline-fired or diesel-fired automobile engine, a marine diesel engine, or a stationary gas engine. Such engines may be sump lubricated, and the lubricant may be provided to the sump from whence it may lubricate the moving parts of the engine. Alternatively, the lubricant may be supplied from a separate source, not a part of a sump.

The internal combustion engine may be a diesel fueled engine, as indicated above, especially a heavy duty diesel engine, or it can be a gasoline fueled engine, a natural gas fueled engine, a mixed gasoline/alcohol fueled engine, or a hydrogen fueled internal combustion engine. The internal combustion engine may be a diesel fueled engine or a gasoline fueled engine.

The internal combustion engine may be a heavy duty diesel engine. The internal combustion engine may be a 2-stroke or 4-stroke engine. Suitable internal combustion engines may include marine diesel engines (which may comprise a cylinder which is lubricated with said lubricant), aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

One class of internal combustion engines is direct injected combustion engines wherein the fuel is injected directly into the cylinder. Specific examples of direct injection may include wall guided and spray guided direct injection engines. The lubricant composition may be used to lubricate a gasoline direct injection engine.

The lubricant composition may be suitable for use as any engine lubricant irrespective of the sulfur, phosphorus or sulfated ash content. The sulfur content of the lubricant composition when used as an engine oil may be about 1 wt % or less, or about 0.8 wt % or less, or about 0.5 wt % or less, or about 0.3 wt % or less. The sulfur content may be in the range of about 0.001 wt % to about 0.5 wt %, or about 0.01 wt % to about 0.3 wt %. The phosphorus content may be about 0.2 wt % or less, or about 0.12 wt % or less, or about 0.1 wt % or less, or about 0.085 wt % or less, or about 0.08 wt % or less, or about 0.06 wt % or less, or about 0.055 wt % or less, or about 0.05 wt % or less. The phosphorus content may be from about 0.04 wt % to about 0.12 wt %. The phosphorus content may be from about 100 ppm to about 1000 ppm, or about 200 ppm to about 600 ppm. The total sulfated ash content may be about 0.3 wt % to about 1.2 wt %, or about 0.5 wt % to about 1.1 wt % of the lubricant composition. The metal content of the lubricant composition, as measured by sulfated ash, may be from about 0.3 wt % to about 1.2 wt %, or from about 0.5 wt % to about 1.1 wt % sulfated ash. The lubricant composition may be characterized by a chlorine content of up to about 100 ppm, or up to about 50 ppm, or up to about 10 ppm.

The lubricant composition may be an engine oil, wherein the lubricant composition may be characterized as having at least one of (i) a sulfur content of about 0.5 wt % or less, (ii) a phosphorus content of about 0.12 wt % or less, and (iii) a sulfated ash content of about 0.5 wt % to about 1.1 wt % of the lubricant composition.

The lubricant composition may be a marine diesel cylinder lubricant, which may be used to lubricate a marine diesel cylinder. The marine diesel cylinder may be in a 2-stroke marine diesel engine. Marine diesel cylinder lubricants are typically used for one pass and are consumed, rather than being retained in a sump. These lubricants may require a high detergent level, imparting high levels of basicity as measured by TBN to the lubricant, typically resulting in TBN levels of about 20 or greater, such as about 30 or greater, or about 40 or greater, or about 50 or greater, or about 70 or greater, and typically up to about 80, or up to about 100, or up to about 300.

Example 1

The inventive lubricant composition is tested in a Caterpillar 3416A rebuilt diesel engine to evaluate the lubricant for its foaming and air entrainment characteristics. The inventive lubricant, which is identified in the table below as Example 1, is compared to three lubricant formulations outside the scope of the invention, these formulations being identified in the table below as Example C-1, Example C-2 and Example C-3.

Example C-1 is a SAE 15W-40 heavy-duty diesel engine oil lubricant that is commercially available. This formulation has been used as a crankcase lubricant in large diesel mining engine equipment and is believed to be a representative baseline for heavy duty diesel engine oils. The Caterpillar 3416A rebuilt engine is operated using this formulation. No foaming or air entrainment issues are observed throughout the test.

Example C-2 is a lower viscosity grade (SAE 10W-30) formulation that is designed to provide for fuel economy benefits without sacrificing protection from premature wear (engine durability). This formulation is placed in the Caterpillar 3416A engine after an oil flushing procedure to remove the Example C-1 formulation. Example C-2 shows a propensity to entrain air (foam) within the first 24 hours of testing. The air "bubbles" found in Example C-2 would be considered a problem by equipment owners.

To address the foaming issue, a small quantity of neat (undiluted) antifoaming agent (i.e., the polydimethyl siloxane in Foam inhibitor A shown in the table below) is added to the crankcase oil. The decision to top-treat the Example C-2 formulation 2 with additional antifoam agent is based upon laboratory tests which show that added antifoam agent helps reduce foaming in Sequence II ASTM D 892 and ASTM D 6082 foam bench tests. The polydimethylsiloxane top treat is added to the crankcase and engine testing is resumed, but the level of foaming is not reduced. At this point, the engine test is stopped.

Example C-3, with 2.2 times the level of polydimethylsiloxane antifoaming agent as compared to Example C-2 (i.e., 200 ppm), is prepared and tested using ASTM D 892 and ASTM D 6082 foam bench tests. The bench test results show no improvement on foam reduction.

Since the use of a single antifoam agent, as provided in Examples C-2 and C-3, does not provide a solution to the problem of reducing or eliminating the foaming tendency of the SAE 10W-30 formulation used in the examples, a mixture of antifoam agents is tested. The mixture that is used is shown in Example 1. The Example 1 formulation is tested using another Caterpillar 3416A engine rebuild. Example 1 is tested using the same mining duty cycle that is used during the test run for Example C-1. Example 1 shows no foaming throughout the duration of the test. Also, Example 1 shows equivalent performance for wear and durability as compared to the baseline Example C-1 performance.

TABLE 1

| | Example 1 | Example C-1 | Example C-2 | Example C-3 |
|---|---|---|---|---|
| Viscosity Grade | 10W-30 | 15W-40 | 10W-30 | 10W-30 |
| Base Oil | Group III | Group II | Group III | Group III |
| Olefin copolymer viscosity modifier | 2.0% | 6.7% | 2.0% | 2.0% |
| Foam inhibitor A: 10 wt % polydimethylsiloxane and 90 wt % naphthenic oil (viscosity neat at 25° C.: 30,000 $mm^2/s$)† | 200 ppm | 107 ppm | 90 ppm | 200 ppm |
| Foam inhibitor B: 12.5 wt % polydimethylsiloxane and 87.5 wt % naphthenic oil (viscosity neat at 25° C.: 100,000 $mm^2/s$)† | 15 ppm | — | — | — |
| Foam inhibitor C: 75 wt % poly(3,3,3-trifluoropropyl methyl siloxane) and 25 wt % methylbutyl ethyl ketone solvent (viscosity neat at 25° C.: 300 $mm^2/s$)† | 40 ppm | — | — | — |
| ppm Si | 20 | 4 | 4 | 10 |
| Diesel oil additive package* | 14.00% | 16.90% | 14.00% | 14.00% |
| Total Dispersant, % (oil free) | 3.9 | 5.0 | 3.9 | 3.9 |
| ppm N | 920 | 1200 | 920 | 920 |
| % Soaps | 1.28 | 1.67 | 1.28 | 1.28 |
| ppm Ca | 2900 | 2500 | 2900 | 2900 |
| ppm Mg | 8 | 110 | 8 | 8 |
| ppm Zn | 1300 | 1500 | 1300 | 1300 |
| ppm Mo | 20 | 0 | 20 | 20 |
| ppm S | 3800 | 4800 | 3800 | 3800 |
| ppm P | 1200 | 1300 | 1200 | 1200 |
| ppm B | 20 | 23 | 20 | 20 |
| TBN (ASTM D2896, mg KOH/g) | 9.3 | 12 | 9.3 | 9.3 |
| Sulfated Ash, % (ASTM D 874) | 1.2 | 1.5 | 1.2 | 1.2 |
| Caterpillar 3516A Engine Test | No Foam | No Foam | Foaming | Foaming |

*Diesel oil additive package contains mixture of dispersants, overbased detergents, antiwear agent, antioxidant, copper passivator, compatibility agent, pour point dispersant and diluent oil. "% Soaps" refers to the amount of the neutralized substrate from the overbased detergent components, excluding excess $CaCO_3$, $MgCO_3$, diluent oil, and the like.
†Amounts of foam inhibitors include the listed oil/solvent.

It has been observed that merely increasing the concentration of an antifoam agent beyond a certain level tends to provide little further benefit in foam inhibition. Hence the performance of the present combination of antifoam agents is particularly notable.

The applicants have observed that in certain instances foam formation of lubricants is more severe in the absence of or with a reduced amount of a polymeric viscosity modifier; in the absence of or with a reduced amount of antioxidant; and/or in the presence of or with an increased amount of a detergent or detergent system that delivers soap substrate and/or basicity (TBN). Accordingly, the present technology may be more beneficial under any or a combination of any or all of those conditions.

While the invention has been explained in relation to various embodiments, it is to be understood that various modifications thereof may become apparent to those skilled in the art upon reading this specification. Therefore, it is to be understood that the invention includes all such modifications that may fall within the scope of the appended claims.

The invention claimed is:

1. A lubricant composition, comprising:

an oil of lubricating viscosity;

a detergent comprising an overbased calcium sulfonate, an overbased calcium phenate, or a mixture thereof;

a dispersant;

a zinc dialkyldithiophosphate;

(1) about 5 to about 50 ppm of a first anti-foam agent comprising a polydimethyl siloxane having a kinetic viscosity (absent solvent) at 25° C. in the range from about 10,000 to about 50,000 $mm^2/s$ (cSt);

(2) about 0.5 to about 13 ppm of a second anti-foam agent comprising a polydimethyl siloxane having a kinetic viscosity (absent solvent) at 25° C. in the range from about 80,000 to about 120,000 $mm^2/s$ (cSt); and (3) about 3.7 to about 35 ppm of a third anti-foam agent comprising a fluorinated polysiloxane having a kinematic viscosity (absent solvent) at 25° C. in the range from about 50 to about 500 $mm^2/s$ (cSt).

2. The composition of claim 1 wherein the composition is a multigrade composition, further comprising a viscosity index improver.

3. The composition of claim 1 wherein the composition further comprises at least one of an antiwear agent, an antioxidant, a friction modifier, a pour point depressant, a metal deactivator, a corrosion inhibitor, a dispersant viscosity modifier, an extreme pressure agent, a demulsifier, a seal swelling agent, or a mixture of two or more thereof.

4. The composition of claim 1 wherein the lubricant composition has a kinematic viscosity at 100° C. of up to about 12.5 cSt.

5. The composition of claim 1 wherein the dispersant comprises a polyisobutene substituted succinimide, a borated polyisobutene substituted succinimide, or a mixture thereof.

6. The composition of claim 1 wherein the first anti-foam agent is provided to the lubricant in the form of a solution or dispersion of from about 1 to about 50% by weight of the polydimethyl siloxane in a solvent.

7. The composition of claim 6 wherein the solvent comprises a naphthenic hydrocarbon solvent.

8. The composition of claim 1 wherein the second anti-foam agent is provided to the lubricant in the form of a solution or dispersion of from about 1 to about 50% by weight of the polydimethyl siloxane in a solvent.

9. The composition of claim 8 wherein the solvent comprises a naphthenic hydrocarbon solvent.

10. The composition of claim 1 wherein the fluorinated polysiloxane of the third anti-foam agent comprises poly(3,3,3-trifluropropyl methyl siloxane).

11. The composition of claim 1 wherein the third anti-foam agent is provided to the lubricant in the form of a solution or dispersion of from about 5 to about 95% by weight of the fluorinated polysiloxane in a solvent.

12. The composition of claim 11 wherein the solvent comprises a ketone having about 5 to about 16 carbon atoms.

13. The composition of claim 1 wherein the lubricant composition has a sulfur content of about 1% by weight or less.

14. The composition of claim 1 wherein the lubricant composition has a phosphorus content of about 0.2% by weight or less.

15. The composition of claim 1 wherein the lubricant composition has a metal content as measured by sulfated ash in the range from about 0.3 to about 1.2% by weight sulfated ash.

16. A method of lubricating an engine, comprising: supplying to the engine the lubricant composition of claim 1.

17. The method of claim 16 wherein the engine is a diesel engine having an output of at least about 750 kW (1000 horsepower).

* * * * *